US005135631A

United States Patent [19]

Utsugi

[11] Patent Number: 5,135,631

[45] Date of Patent: Aug. 4, 1992

[54] ELECTRODEPOSITION DRUM

[75] Inventor: Fukuzo Utsugi, Imaichi, Japan

[73] Assignee: Furukawa Circuit Foil Co., Ltd., Tokyo, Japan

[21] Appl. No.: 636,678

[22] Filed: Jan. 2, 1991

[30] Foreign Application Priority Data

Sep. 6, 1990 [JP] Japan ..... 2-234590

[51] Int. Cl.[5] ..... C25D 17/10

[52] U.S. Cl. ..... 204/216

[58] Field of Search ..... 204/216

[56] References Cited

U.S. PATENT DOCUMENTS 4,240,894 12/1980 Adler ..... 204/208
4,921,590 5/1990 Khalid ..... 204/216
4,975,169 12/1990 Murayama ..... 204/216

FOREIGN PATENT DOCUMENTS 58-24507 5/1983 Japan .
61-60149 12/1986 Japan .

*Primary Examiner*—T. M. Tufariello
*Attorney, Agent, or Firm*—Frishauf, Holtz, Goodman & Woodward

[57] ABSTRACT

Disclosed is an electrodeposition drum having an inner drum and a cylindrical outer skin provided on the circumferential surface of said inner drum, characterized in that a wire rod having higher coefficient of thermal expansion than those of the inner drum and the outer skin, good electrical conductivity and excellent corrosion resistance is wound around the circumferential surface of said inner drum, and then the outer skin is shrink-fitted on said wound wire rod, whereby not only electrical conductivity between the inner drum (1) and the outer skin (2) can be improved but also contact resistance therebetween can be reduced, and thus the electrodeposition drum according to this invention allows high electric current to be flowed thereto.

1 Claim, 4 Drawing Sheets

Fig. 3
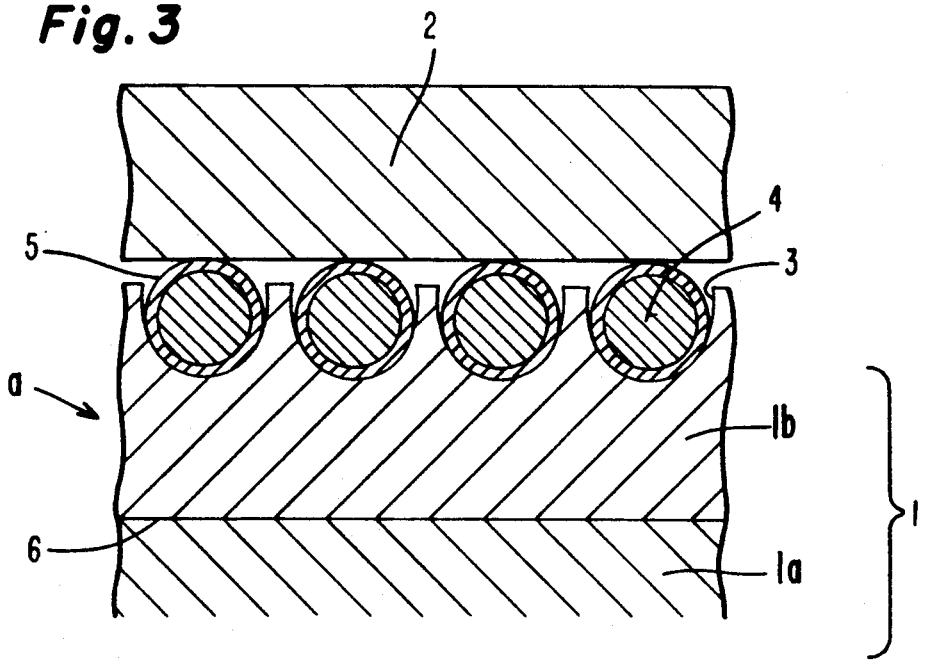
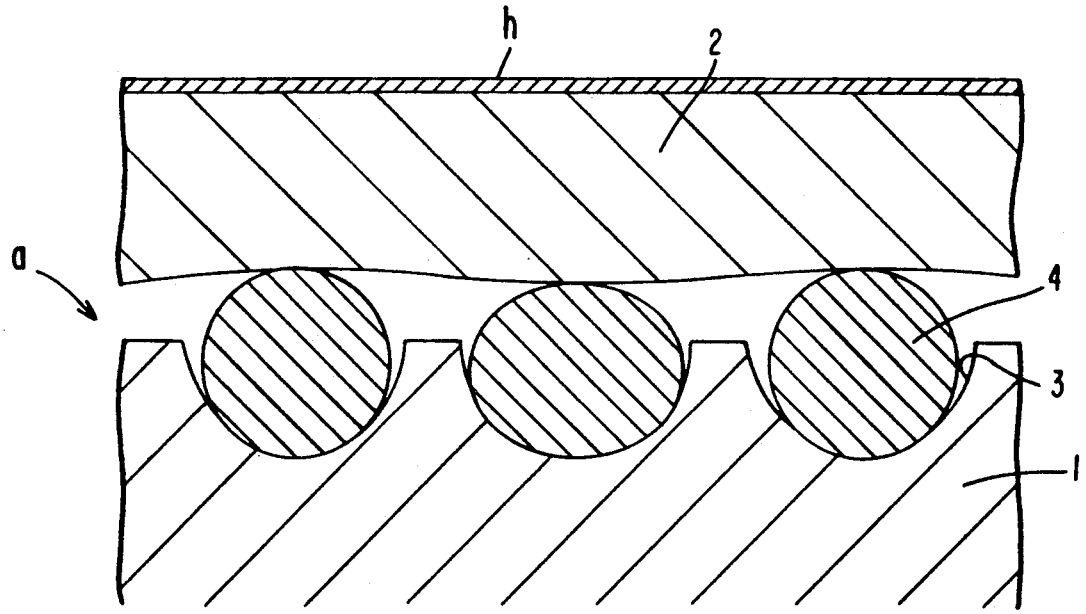
Fig. 4

ELECTRODEPOSITION DRUM

BACKGROUND OF THE INVENTION

This invention relates to an electrodeposition drum to be used for manufacturing metal foils such as copper foils, iron foils, stainless steel foils, etc. by means of electrodeposition.

Such type of known electrodeposition drum comprises an inner drum having grooves on the surface thereof to provide reduced area of contact with the internal surface of the outer skin and further a silver plating layer incorporated on the contact surface (Japanese Patent Publication No. 24507/1983); or comprises an outer skin at least having a plating layer such as of silver plating, platinum plating or gold plating on the internal surface (Japanese Patent Publication No. 60149/1986), in order to enhance electrical conductivity between the inner drum and the outer skin.

FIGS. 5 and 6 each show a typical structure of prior art electrodeposition drum.

In the illustrated structure, the electrodeposition drum (a) comprises an inner drum (1) made of carbon steel and the like and an outer skin (2) made of titanium and the like, which is fitted on the external surface of said inner drum by shrinkage fitting. The electrodeposition drum (a) has a shaft (b) connected to a driving source for rotating said drum (a) and rotatably supported by a pair of bearings (c,d). The lower portion of the electrodeposition drum (a) is immersed in an electrolytic solution (f) filled up in an electrolyte tank (e), and an electric current is flowed across the electrodeposition drum (a) as a cathode and an anode (g) disposed in the electrolyte tank (e), i.e. from the outer skin (2) to the inner drum (1), so that an electrodeposited metal layer (h) or metal foil may be formed on the portion of the external surface of the electrodeposition drum (a) while it is immersed in the electrolytic solution (f) as the electrodeposition drum (a) rotates. By removing the deposited metal layer (h) from the external surface of the electrodeposition drum (a) metal foil can continuously be manufactured.

In the above-described prior art (Japanese Patent Publication No. 60149/1986), shrinkage fitting of the outer skin (2) has been employed for improved bond or adhesion between the inner drum (1) and the outer skin (2) and decreasing contact resistance therebetween. However, only by the adhesion achieved by shrinkage fitting the contact between the external surface of the inner drum (1) and the internal surface of the outer skin (2) will inevitably be nonuniform. As shown in FIG. 7, gaps (R) will irregularly be formed between said two surfaces to cause nonuniform electrical conductivity, and the electrodeposited metal layer (h) or metal foil comes to have nonuniform thickness or undergoes anomalous deposition and discoloration due to local overheat, or so-called hot spot, and consequently the production speed cannot be accelerated since a large amount of electric current cannot flow therethrough.

In the electrodeposition drum of Japanese Patent Publication No. 24507/1983, irregular gaps (R) are also present between the two surfaces as shown in FIG. 8, and thus the electrical conductivity between the two surfaces can hardly be improved sufficiently.

SUMMARY OF THE INVENTION

This invention is directed to overcome the inconveniences of the prior art and provides an electrodeposition drum having an inner drum and a cylindrical outer skin provided on the circumferential surface of said inner drum, characterized in that a wire rod having higher coefficient of thermal expansion than those of the inner drum and the outer skin, good electrical conductivity and excellent corrosion resistance is wound around the circumferential surface of said inner drum, and the outer skin is shrink-fitted on said wound wire.

Thus, the electric current flows uniformly from the outer skin to the inner drum through the wire wound around the circumferential surface of the inner drum.

BRIEF DESCRIPTION OF THE DRAWINGS

FIG. 3 is a partial cross-sectional view of a third embodiment of this invention;

FIG. 4 schematically shows, in partially enlarged cross section, the effect of this invention to be exhibited when the contact between the inner drum and the outer skin is not uniform;

DESCRIPTION OF PREFERRED EMBODIMENTS

Figure 1:
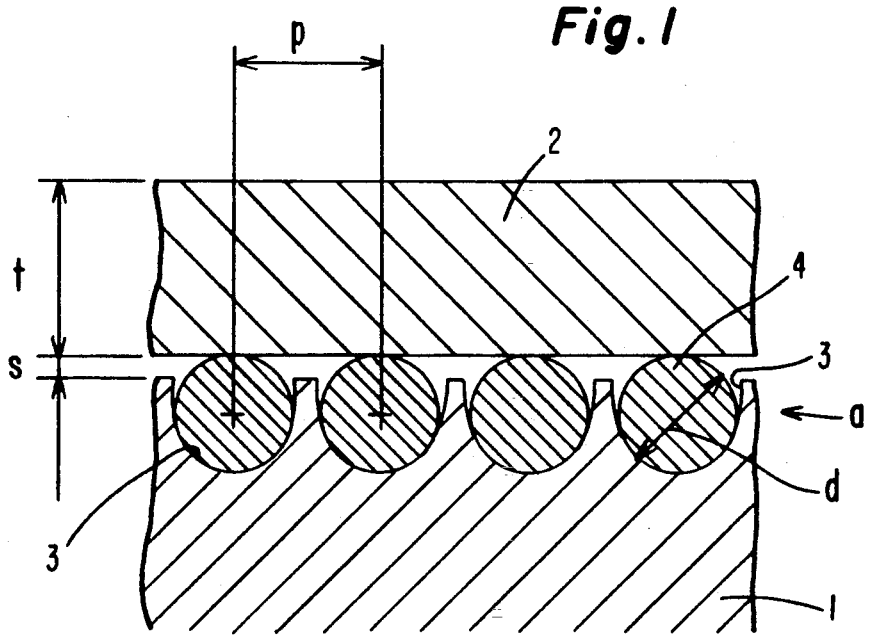
FIG. 1 is a partial cross-sectional view of a first embodiment of this invention.
Figure 2:
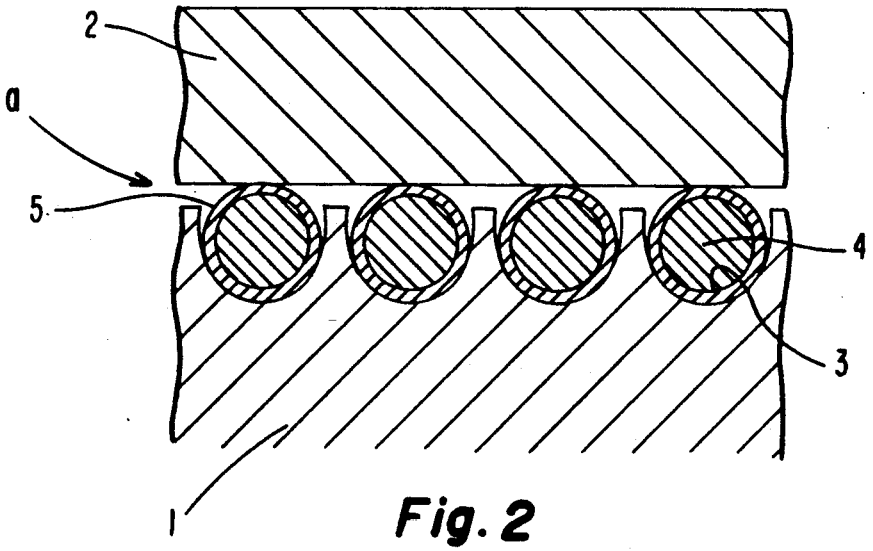
FIG. 2 is a partial cross-sectional view of a second embodiment of this invention.
Figure 5:
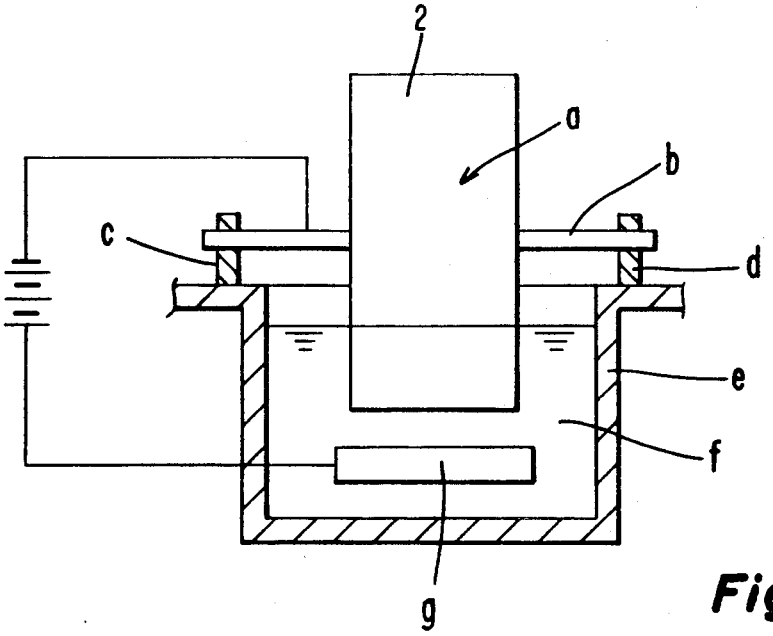
FIG. 5 shows, in cross section, the entire constitution of the prior art electrodeposition drum.

This invention will be described in detail by way of preferred embodiments referring to the attached drawings. FIGS. 1 to 3 show embodiments of this invention, i.e. a first embodiment, a second embodiment and a third embodiment, respectively, wherein the same reference numerals are attached to the portions corresponding to those of the prior art electrodeposition drum.

In the first embodiment (FIG. 1), the reference numeral (1) shows a carbon steel inner drum having a U-shaped groove (3) formed spirally around the external surface of said inner drum (1), on which a copper wire as the wire rod (4) having good electrical conductivity is wound along said groove (3). The reference numeral (2) shows an outer skin made of titanium, tantalum, niobium, zirconium or an alloy thereof, which is shrink-fitted on the wire rod (4). In other words, the basic structure of the electro-deposition drum can be established by fitting a heated outer skin (2) on the inner drum (1) and then leaving it for cooling.

In this embodiment, outer skin (2) has a thickness [t] of 4.5 mm; the wire rod (4) has a diameter [d] of 2.6 mm; the clearance between the external circumferential surface of the inner drum (1) and the internal surface of the outer skin (2), i.e. the height [s] of the portion of the wire rod (4) protruding from the circumferential surface of the inner drum (1) is 0.6 mm; and the winding pitch [p] of the wire rod (4) is 2.9 mm.

Figure 6:
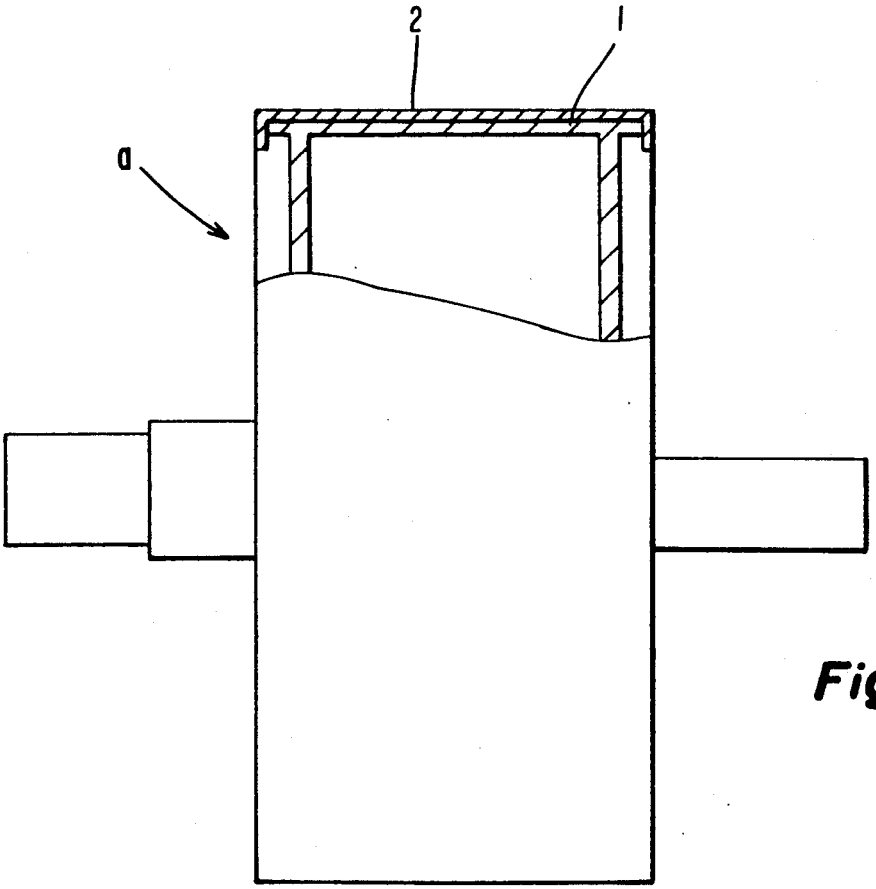
FIG. 6 shows a partially enlarged cross section of the prior art electrodeposition drum.
Figure 7:
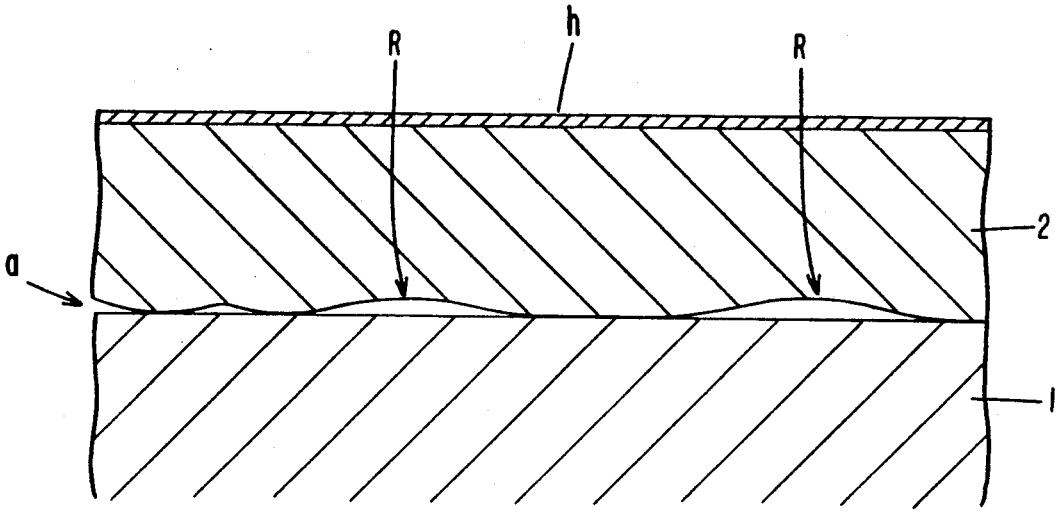
FIGS. 7 and 8 each show, in partially enlarged cross section, nonuniform contact between the inner drum and the outer skin in the prior art electrodeposition drum.
Figure 8:
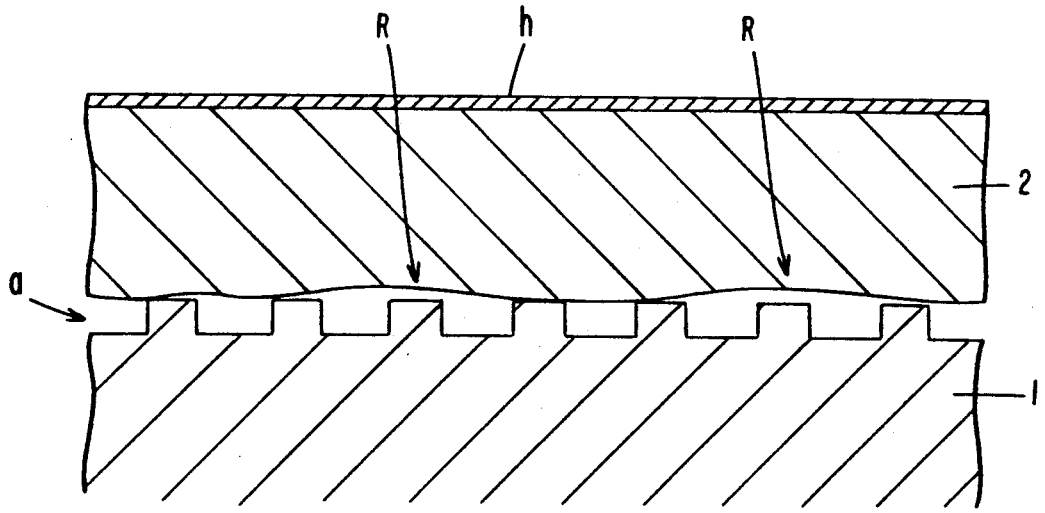

The above constitution can overcome the prior art problems or such nonuniform contact between the external surface of the inner drum (1) and the internal surface of the outer skin (2) if occurred as shown in FIG. 6 since a soft copper wire is present to compensate for the gaps or such portions where the contact pressure between the outer skin (2) and the inner drum (1) is low or where there is a degree of deformation or roughness on the outer skin (2) as shown in FIG. 4 to maintain uniform the overall contact between the two surfaces. In addition, when the electrodeposition drum is actually immersed in an electrolytic solution and an electric current is flowed thereto, the electrical conductivity between the inner drum (1) and the outer skin (2) can more strongly be achieved because of the heat of the electrolytic solution and the heat of Joule effect, so that detrimental effect of nonuniform electrical conductivity due to hot spot and the like can be prevented from occurring, allowing flowing of a super high level of electrical current.

Incidentally, the material of the inner drum (1) is not limited to carbon steel but can be copper or stainless steel.

The embodiments and specifications of the wire rod (4) can suitably be selected depending on the conditions where the electrodeposition drum is used.

In the first embodiment, a single wire is spirally wound around the circumferential surface of the inner drum (1). However, a cable comprising intertwined fine wires can be used as the wire rod (4). Alternatively, a plurality of C-shaped simple rings may be used.

The wire rod (4) desirably has a diameter of 0.5 to 8 mm, more preferably 1 to 5 mm. If it has a diameter of larger than 8 mm, the contact area between the outer skin (2) and the wire rod (4) will be too small, making it difficult to flow a high level of electric current. On the other hand, if it has a diameter of less than 0.5 mm, not only the procedure of forming the groove (3) requires enormous labor, but also uniform winding of the wire rod (4) along said groove (3) will become difficult, and consequently, good electrical conductivity cannot be attained between the two circumferential surfaces.

The winding pitch of the wire rod (4) is preferably selected from the range of [d] to [d+30] mm.

The shape of the groove (3) is not limited to U shape but can suitably be selected in consideration of the diameter [d], winding pitch [p] and protrusion height [s] of the wire rod (4), as well as, ease of processing said groove.

In the second embodiment (FIG. 2) of electrodeposition drum according to this invention, the wire rod (4) has a plating layer (5) such as of silver, tin, nickel, gold, platinum, palladium or an alloy thereof formed on the surface thereof.

In the second embodiment, the similar action and effect to those in the first embodiment can be obtained, and further oxidation on the surface of the wire rod (4) or copper wire can be inhibited by the presence of the plating layer (5).

The third embodiment (FIG. 3) shows another embodiment of the electrodeposition drum according to this invention, wherein the inner drum (1) is formed by shrinkage fitting a copper cylindrical member (1*b*) on the circumferential surface of a carbon steel drum member (1*a*) through a copper plating layer (6); and a wire rod (4) is wound on the circumferential surface of the thus formed inner drum (1) or the cylindrical member (1*b*).

In the third embodiment, either, the similar action and effect to the those of the preceding embodiments can be achieved.

The electrodeposition drums according to the first to third embodiments and the prior art electrodeposition drums shown in FIGS. 5 to 8 were used for continuous electrolysis for 6 months, and the results are summarized in the following table.

| | Current density of cathode | |
|---|---|---|
| | 50–60 A/dm$^2$ | 130–150 A/dm$^2$ |
| First embodiment | No hot spot appeared | No hot spot appeared |
| Second embodiment | No hot spot appeared | No hot spot appeared |
| Third embodiment | No hot spot appeared | No hot spot appeared |
| Prior Art | Hot spots started to occur after 2 months and white spots were formed on the foil. | Hot spots started to occur after 1.5 months and white spots were formed on the foil. |

As can be seen from the results, according to the electrodeposition drum of this invention, electricity can uniformly be flowed over the entire surface, and detrimental effect due to nonuniform electrical conductivity including hot spot can be prevented from occurring to greatly increase the total amount of electricity to be flowed, and thus the operation can be accelerated.

What is claimed is:

1. An electrodeposition drum having an inner drum and a cylindrical outer skin provided on the circumferential surface of said inner drum, characterized in that a wire rod having higher coefficient of thermal expansion than those of the inner drum and the outer skin, good electrical conductivity and excellent corrosion resistance is wound around the circumferential surface of said inner drum, and then the outer skin is shrink-fitted on said wound wire rod.

* * * * *